US007053766B2

(12) United States Patent
Fisler et al.

(10) Patent No.: US 7,053,766 B2
(45) Date of Patent: May 30, 2006

(54) SELF-TESTING SYSTEM AND METHOD

(75) Inventors: Charles F. Fisler, Sycamore, IL (US); Jeffrey M. Klein, Chicago, IL (US)

(73) Assignee: Honeywell International, Inc., Morristown, NJ (US)

( * ) Notice: Subject to any disclaimer, the term of this patent is extended or adjusted under 35 U.S.C. 154(b) by 63 days.

(21) Appl. No.: 10/699,939

(22) Filed: Nov. 3, 2003

(65) Prior Publication Data

US 2005/0093689 A1 May 5, 2005

(51) Int. Cl.
*G08B 29/00* (2006.01)

(52) U.S. Cl. ..... 340/514; 340/515; 340/516

(58) Field of Classification Search ..... 340/293, 340/512, 286.1, 614, 615, 617, 331, 501, 340/506, 507, 514, 515, 516, 531, 635, 692, 340/571; 73/290 V, 119 A, 313; 118/715, 118/723 E; 166/250.03; 714/733; 700/286
See application file for complete search history.

(56) References Cited

U.S. PATENT DOCUMENTS

| | | | | |
|---|---|---|---|---|
| 4,369,398 | A * | 1/1983 | Lowry, Sr. | 318/114 |
| 4,932,246 | A * | 6/1990 | Deutsch et al. | 73/119 A |
| 5,225,994 | A * | 7/1993 | Arinobu et al. | 700/286 |
| 5,400,009 | A | 3/1995 | Kosich et al. | 340/331 |
| 5,598,139 | A | 1/1997 | Karim et al. | 340/286.11 |
| 5,608,375 | A | 3/1997 | Kosich | 340/293 |
| 5,635,912 | A * | 6/1997 | McCracken | 340/692 |
| 5,751,210 | A | 5/1998 | Kosich | 340/293 |
| 5,850,178 | A | 12/1998 | Ha et al. | 340/512 |
| 6,194,994 | B1 | 2/2001 | Curran et al. | 340/293 |
| 6,559,767 | B1 * | 5/2003 | Huang | 340/571 |
| 6,782,498 | B1 * | 8/2004 | Tanizaki et al. | 714/733 |
| 2002/0125840 | A1 | 9/2002 | Ha et al. | |

* cited by examiner

*Primary Examiner*—Van T. Trieu
(74) *Attorney, Agent, or Firm*—Welsh & Katz, Ltd.

(57) ABSTRACT

Newly installed electrical units emit, for a brief install interval, an "installed" output either audibly or visually, or both in response to an install mode input signal. After the install interval, the "installed" output ceases. As more units are installed, the earliest installed units remain silent in the presence of the install mode input signal.

25 Claims, 5 Drawing Sheets

SELF-TESTING SYSTEM AND METHOD

FIELD OF THE INVENTION

The invention pertains to modular electrical units installable in a distributed system. More particularly, the invention pertains to units with a self-test or install mode indicative of proper installation and operation of the unit.

BACKGROUND

Ambient condition detection systems, such as fire alarm systems, often provide a separate loop for audible/visible output devices. In these devices, horns and/or strobes can be driven to emit alarm indicating outputs as appropriate. One exemplary form of audible/visible output device has been disclosed in U.S. patent application Ser. No. 10/040,968 filed Jan. 2, 2002 for Processor Based Strobe with Feedback assigned to the assignee hereof and incorporated by reference herein.

Normally this loop is not energized. It might have a non-operational (reversed) voltage applied thereto during non-alarm intervals for supervision purposes. To activate the devices the polarity of the loop voltage is reversed from for example, minus 5 volts to plus 24 volts. As is well known, all the devices on the loop will then emit audible and/or visible alarm indicating outputs. Having all the devices on the loop active at once, as described below can at times be undesirable.

Such devices are often respectively controlled or synchronized by a periodic control pulse or pulses embedded in the driving voltage. Such systems have been disclosed and claimed in U.S. Pat. No. 5,598,139 for Fire Detecting System with Synchronized Strobe Lights and U.S. Pat. No. 5,850,178 for Alarm System Having Synchronizing Pulse Generator and Synchronizing Pulse Missing Detector assigned to the assignee hereof and incorporated by reference herein.

Pulse width modulation or pulse position modulation can be combined with such pulse sequences to provide additional control functions all without limitation. The synchronizing or controlling pulse trains or sequences are usually responded to by all of the devices on the loop for the duration of time during which the pulses are present on the loop.

It has also been recognized that there is virtue in modularizing such systems and making it easy to install and/or replace electrical units including ambient condition detectors, output devices and the like all without limitation. Hence, such electrical units are often equipped with quick connect/disconnect-type contacts whereby one portion of the contact is permanently installed in a part of the system, and, the other portion of the contact is carried by the electrical unit. When the two parts of the contact mate, the connection is completed and the electrical unit can be expected to perform as expected.

It is also known that it is desirable to be able to test such electrical units at the time of installation and/or on a periodic basis thereafter. Testing can take place by energizing the electrical units in a normal operational fashion and detecting, either automatically or manually, the response of the electrical unit or units thereto. Hence, where the electrical units correspond to output devices, once several of them have been newly installed in the system, all of the output devices on that particular loop can be driven and the operationality of the newly installed units, as well as all of the preexisting units can be verified. This however, is inconvenient in that it produces nuisance alarm conditions, since all the units are active which is undesirable.

There is a continuing need to be able to verify operationality of newly installed electrical units, be they detectors or output devices, without creating nuisance alarms. Preferably, such indications could be generated conveniently during the installation cycle, substantially immediately when the electrical unit is installed to provide feedback to the installer in real time. Preferably, such feedback capability could be incorporated into electrical units being newly installed in existing systems, as well as those being installed in new systems, without causing substantial additional manufacturing or installation costs in both existing and new systems.

DESCRIPTION OF THE PREFERRED EMBODIMENTS

Figure 1A:
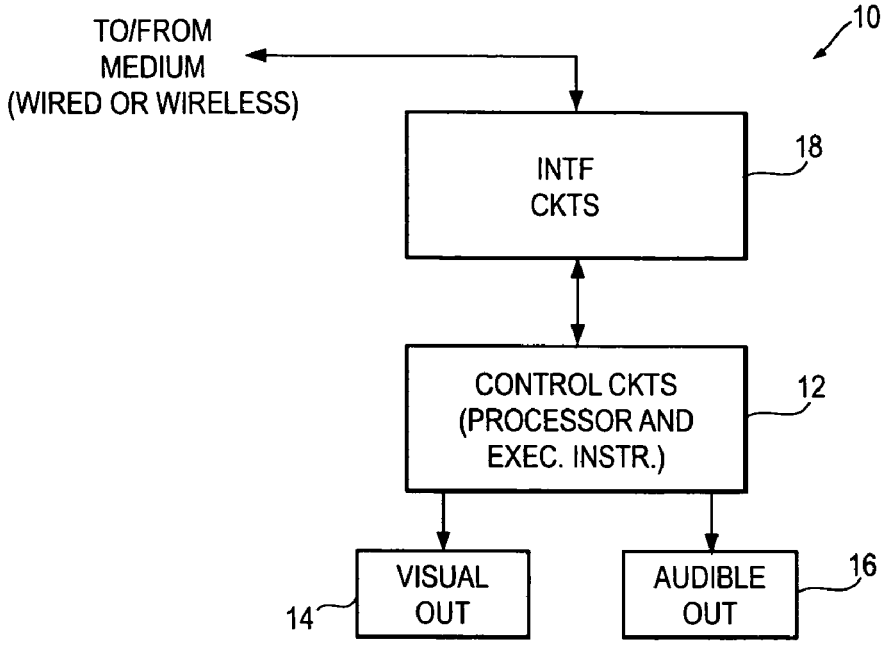
FIG. 1A is a block diagram of an electrical unit in accordance with the invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

An apparatus and a method in accordance with the invention provide a short term test/verification mode each provides substantially immediate feedback to an installer that the respective device is working properly as soon as it has been installed. In a disclosed embodiment, previously installed output devices do not alarm though they are receiving power. As a result, only those devices which have recently been installed or are currently being installed provide audible or visible output(s) indicative of operationality thereof.

In one disclosed embodiment of the invention, alarm indicating electrical output devices are responsive to a predefined set of test mode control signals. When the respective device is installed, and power applied thereto, it automatically enters the install mode for a predetermined install time interval. In this mode, it can respond to received control signals which cause the respective device to emit, during the install time interval, audible or visible outputs which indicate that the device has been installed properly and is functioning as expected.

In one embodiment, once the install interval has expired for a respective device it will no longer respond to received install control signals. It however will respond to other expected control signals in accordance with its predefined protocol.

Where the electrical units correspond to alarm indicating audible and/or visible output devices which are intended to be installed on an output device loop of an alarm monitoring system, control circuits coupled to the loop can provide the required drive voltage and install mode control signals. A variety of different types of modulation such as pulse modulation, amplitude modulation, frequency modulation or the like, all about limitation, can be used for transferring control information on a repetitive basis in the loop all without limitation.

When operating in this mode, the output devices when installed, will enter a test/install mode for a limited time interval after power has been applied thereto. The newly installed device will then provide audible and/or visible output signals for a brief period of time indicative of proper functioning of the device. So long as the install mode signals continue to appear in the loop, though energized, the devices on the loop will not go into alarm. The installer can then go on to the next location on the loop which requires attention.

In one aspect, a test mode, pulse pattern can be provided by synchronizing circuitry coupled to the output device loop. The same circuitry can provide all of the other control signals available to be transmitted to the output devices. Hence, where the loop is energized and the install mode control signals have been provided over an extended period of time, only the most recently installed device will output an audible or visual indicator of proper operation thereof. This immediate feedback makes it possible for the installer to know that the wiring and signals coupled to the device are correct and that the device itself is operating properly.

Where the installer is uncertain as to the operationality of a given unit, he/she can remove it from the loop. After a time interval long enough for any internal energy storage devices to discharge, it can then be reinstalled on the loop for further evaluation. The reinstallation will also reactivate the install mode operational sequence.

FIG. 1A is a block diagram of an exemplary output device 10 in accordance with the invention. The device 10 includes control circuits 12 which could be implemented, at least in part, with a programmable processor, such as a micro processor, along with executable instructions. The control circuits 12 are coupled to one or both of a visual output device 14 and an audible output device 16.

Control circuits 12 are also coupled to interface circuits 18 which provide at least uni-directional communication with a wired or wireless medium. In the case of a wired medium, electrical energy as well as control pulses can be provided by a remote synchronizing source, not shown in FIG. 1A. In the case of a wireless medium, interface circuits 18 can wirelessly receive control signals which are coupled to the control circuits 12.

Inspective of whether the medium is wired or wireless, when the unit(s) are energized, control signals can incorporate, for example, at least one synchronizing command signal which upon receipt by control circuits 12 causes the circuits 12 to drive either or both of output devices 14, 16 synchronously in response thereto. In this mode, the output from devices 14, 16 is indicative of the presence of an alarm condition. Additional control signals, can be provided to units in the system, such as unit 10 to carry out a variety of different functions in a normal operational mode all without limitation.

Interface circuits 18 are adapted to receive install mode control signals which in turn are coupled to control circuits 12. Once power has been applied to the unit 10, the control circuits 12, in response to the install mode control signals, enter an install test and evaluation mode so long as the control signals are present. After outputting an initial indication of operability the respective devices 10 remain silent as long as the install mode control signals are present. Hence, if those signals cease, the units 10 enter a normal alarm state.

Figure 1B:
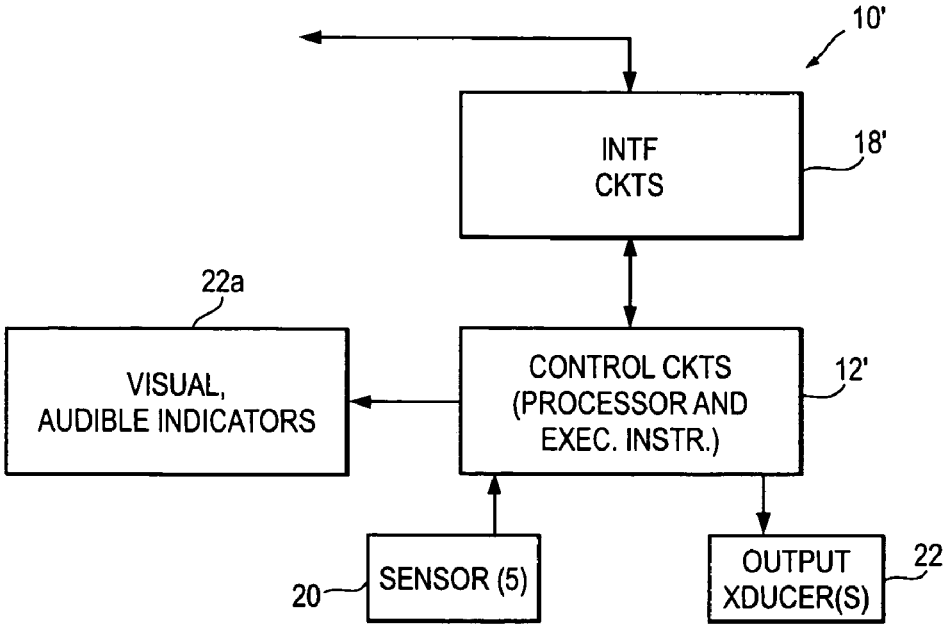
FIG. 1B is a block diagram of an alternate unit in accordance with the invention.

FIG. 1B illustrates an alternate form of an electrical unit 10' in accordance with the invention. The unit 10' incorporates control circuits 12' which can again be implemented at least in part with a micro-processor and executable instructions. Control circuitry 12' is coupled to one or both of ambient condition sensors, or input transducers 20 and/or one or more output transducers 22. As will be understood by those of skill in the art of the sensors or input transducers could, for example, include without limitation motion sensors, thermal sensors, gas sensors, fire sensors including smoke sensors and the like. Output transducers 22 can include solenoids electrical relays, motors or other forms of devices to implement a desired function.

Control circuits 12' can also be coupled to interface circuits 18' which provide uni-directional or bi-directional communication via a wired or wireless medium as discussed above.

The unit 10' can incorporate an install mode generally of the type described above with respect to the unit 10. Proper operation of newly installed units 10' can be indicated by activating one or more visual or audible output devices 22*a* associated with the unit 10' in a fashion indicative of proper operation in the install mode.

Figure 2A:
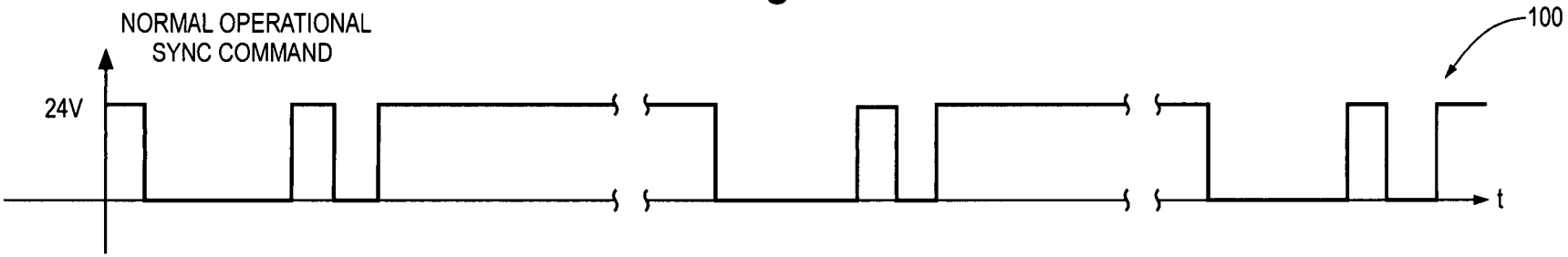
FIG. 2A is a graph of an exemplary control pulse sequence usable with the unit of FIGS. 1A, 1B.
Figure 2B:
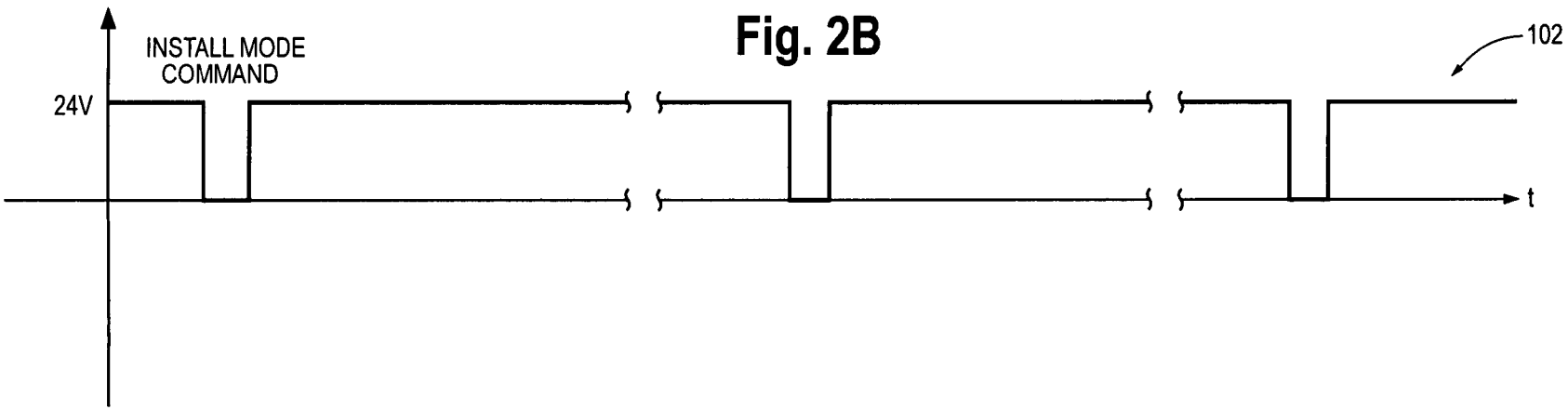
FIG. 2B is a graph of a different pulse sequence usable with the unit of FIGS. 1A, 1B.

FIGS. 2A and 2B are timing diagrams which illustrate voltage applied to the units, such as unit 10 with two embedded, exemplary command signals transmitted using pulse position modulation. It will be understood that FIGS. 2A and 2B are exemplary only and are not limitations of the invention. Neither the exact configuration of the commands nor the type of modulation used are limitations of the present invention.

Commands can be transmitted with various pulse modulation schemes such as pulse position modulation, pulse code modulation, or in other modulation formats such as am modulation, fm modulation or using any other form of modulation all without limitation without departing from the spirit and sculpt of the present invention.

FIG. 2A illustrates a power supplying pulse sequence 100 transmitted on a periodic basis to exemplary electrical units 10 or 10'. Pulse sequence 100 illustrates an exemplary normal operational command which might include operation such as synchronizing output devices 14 or 16, or activating sensors or output transducers 20, 22 all without limitation. The respective electrical unit 10, 10' responds to the repetitive commands 100 received on a periodic, synchronized, basis and this would be understood by those of skill in the art.

FIG. 2B illustrates an exemplary install mode command format 102 which can be transmitted periodically to respective devices or units 10, 10'. Those respective units which had been installed and receive power will respond to the command sequence 102. When a unit is installed and energized, it will provide a brief audible and/or visible output substantially immediately to the installer indicating that the respective unit is properly receiving electrical energy and command sequences such as the command sequence 102. The output audible and visible signals can also indicate that the respective unit is working as expected. Relative to the previously installed output units 10, so long as the install mode signals 102 continue to be received, the units 10 will remain silent, once the initial normal functioning indicator has been emitted.

Figure 3:
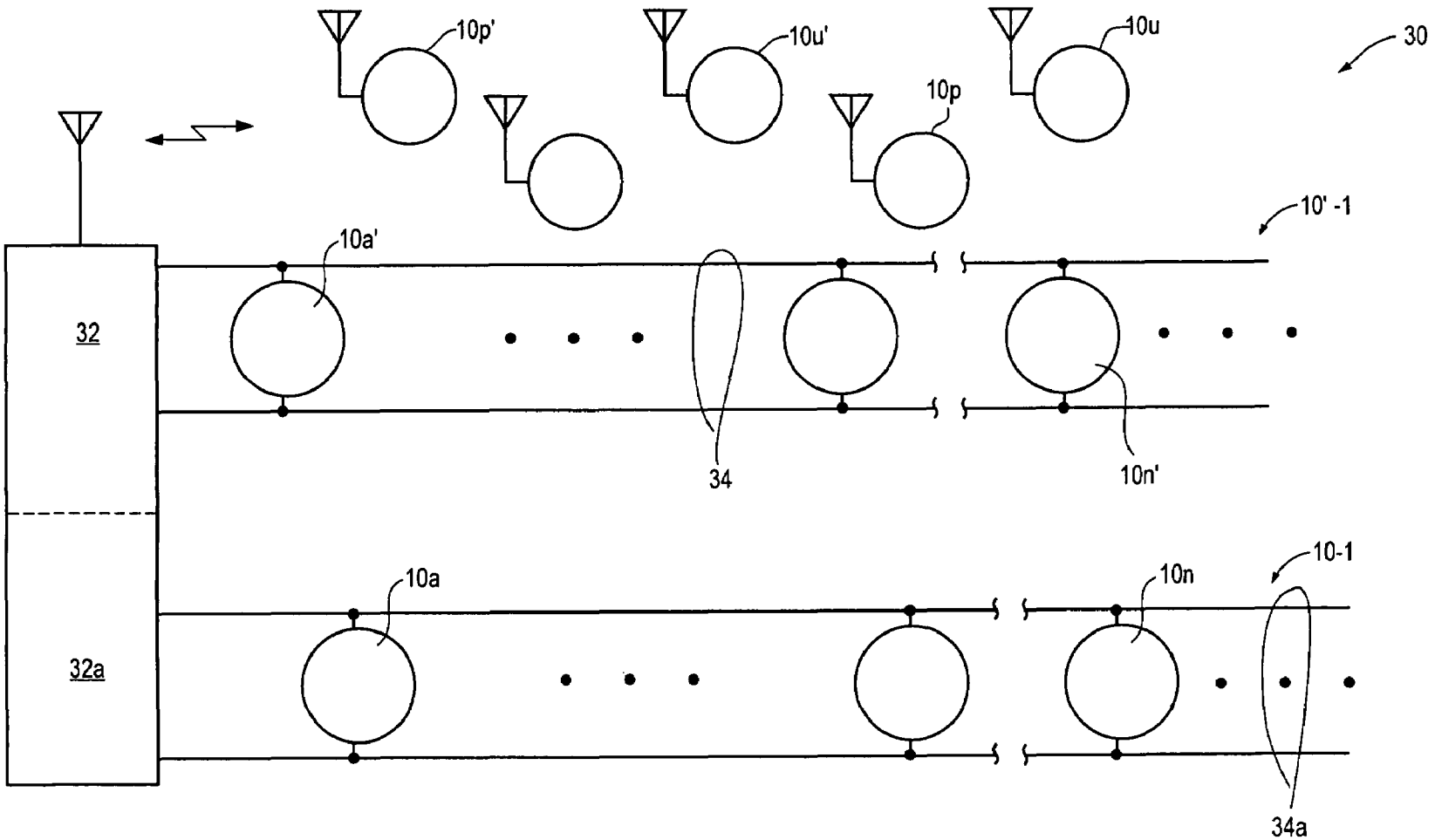
FIG. 3 is a block diagram of an alarm system in accordance with the invention.

FIG. 3 illustrates an exemplary monitoring system 30 which embodies the present invention. The system 30 incorporates control circuitry 32 which can be implemented with one or more interconnected programmed processors, such as micro processors, and associated executable instructions. The control circuits 32 could be distributed physically and spaced apart from one another all without limitation of the present invention.

Coupled to circuitry 32 is a plurality of electrical units 10'-1 which includes 10*a*' . . . 10*n*' of the general type illustrated in FIG. 1B.

The members of the plurality 10'-1 are coupled via a wired medium 34 to control circuitry 32 for uni-directional or bi-directional communication all without limitation. Members of the plurality 10'-1 can be implemented as ambient condition detectors with each incorporating one or more sensors 20 or, alternately, as output devices incorporating output transducers 22 or both.

Some of the members of plurality 10'-1, namely, 10'*p* . . . 10*n*' can be in wireless communication with control circuits 32 all without departing from the spirit and sculpt of present invention.

System 30 can also include a second wired medium 34*a* which can provide uni-directional or bi-directional communication with the control circuitry 32. Coupled to the wired medium 34*a* is a plurality of output devices 10-1 comparable to the output devices 10 of FIG. 1A. The members of the plurality 10-1 namely 10*a* . . . 10*n* can receive electrical energy and/or command sequences from control circuits 32 via the medium 34*a*. Additionally, some of the plurality 10-1 namely 10*p* . . . 10*u* could be in wireless communication with the control circuits 32 without departing from the spirit and sculpt of the invention.

At least some of the members of the plurality 10-1 or 10'-1 could be implemented having the install mode as discussed above. In such event, install mode command sequences, such as command sequence 102 or FIG. 2B could be transmitted from the control circuits 32 via the appropriate medium.

For example if the medium is the loop 34*a*, newly installed members of the plurality 10-1, for example unit 10*n*, would be energized by the voltage on loop 34*a* and respond to sequence 102 with an install mode output perhaps by briefly blinking the visual output device 14 in a predetermined fashion or producing an audible output from the output device 16 of a predetermined type, not indicative of an alarm condition, to advise the installer that the respective unit is properly energized and working as expected.

Once the install interval or window passes relative to that device, not withstanding the fact that the loop 34*a* continues to be energized, so long as the sequence 102 continues to be received, the previously installed units, including unit 10*n* would not go into alarm and would remain silent. Once the signals 102 ceased, the units of the plurality 10-1 would enter an alarm or active output state until the voltage on the loop 34*a* is reversed, or removed.

System 30 could operate in a similar fashion relative to medium 34 and/or wireless devices such as wireless devices 10*p*' . . . 10*u*' or 10*p* . . . 10*u*. In the case of medium 34, an install mode interval could be defined. Newly installed devices, such as detector or output device 10*a*' could respond to the install mode pulse sequence only during the install mode interval. During this interval unit 10*a*' could output an indicator of normal operation. At the end of the install mode interval, the unit 10*a*' could switch to its normal operational mode and ignore the install mode control signals.

Figure 4:
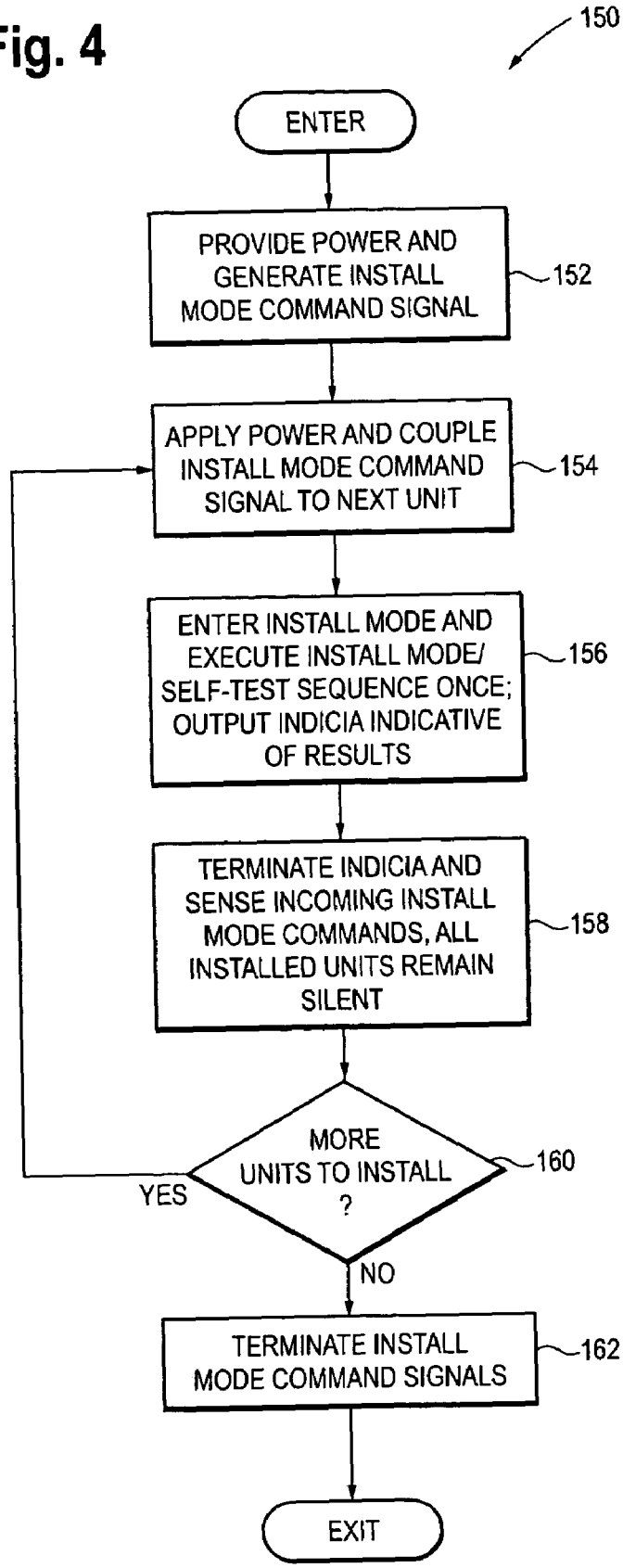
FIG. 4 is a flow diagram illustrating a method in accordance with the invention.

FIG. 4 is a flow diagram of steps of an exemplary method 150 of installing output devices 10. In an initial step 152 electrical energy is coupled to the medium and an install mode command signal is repetitively transmitted on the relevant medium. In a step 154 the next unit to be installed is coupled to the medium and power is applied thereto.

In a step 156 once power is available, the install mode is entered at the unit. If the newly installed unit is operating properly an indicator of proper operation, a visual output or an audible output is produced for the installer for a brief time interval.

In a step 158 the indicator is terminated. The device remains silent though it is still being energized. All other previously installed units also remain silent. If more units are to be installed, steps 154, 156 and 158 are repeated. Otherwise in a step 162 the install mode command signals are terminated.

Figure 5:
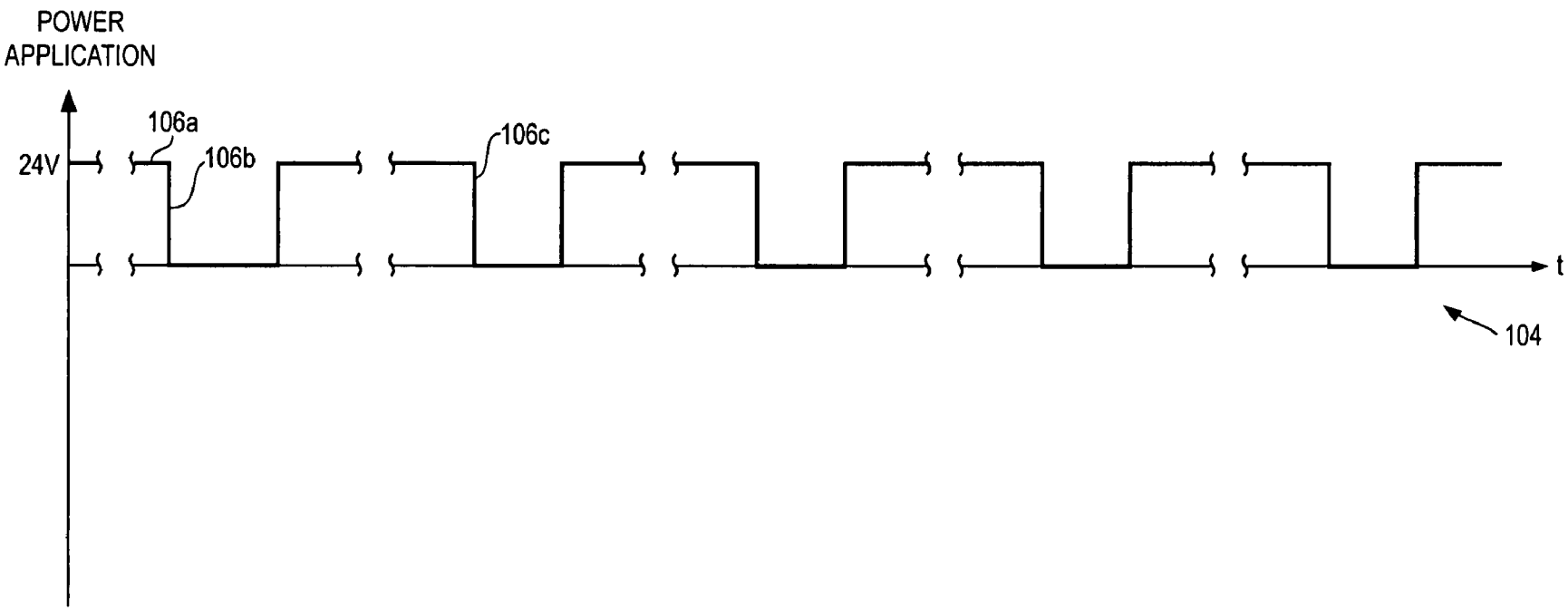
FIG. 5 illustrates an alternate form of a self test/install control pulse wave form.

A preferred method of operating system 30 and loop or medium 34*a* can be implemented using the multi pulse waveform 104 of FIG. 5. FIG. 5 illustrates a pulse width modulated waveform of a type which could be coupled via medium 34*a* to the plurality of alarm indicating output devices 10-1 coupled thereto.

As discussed above, when the loop 34*a* is energized, the members of the plurality 10-1 enter an active state and emit their audible and visible alarm indicating indicia. The waveform of FIG. 5 illustrates a preferred embodiment of implementing a test or install mode for the devices 10.

Waveform 104 exhibits a relatively high voltage, for example 24 volts. Energy supplying portion 106*a* is interrupted by a singular or first pulse of a selected width 106*b* followed by a periodic pulse train of a second pulse 106*c* of a different width. For example and without limitation the pulses 106*c* could have a period on the order of one second. It will be understood that neither the exact form of the pulses 106*b, c*, in the waveform 104, their widths nor periodicity are limitations of the present invention.

When the loop 34*a* is activated, the energizing voltage of 24 volts, segment 106*a* see FIG. 5, is applied to the plurality of output devices 10-1. To avoid the devices going into an alarm state and emitting both their audible and or visual outputs, pulse 106*b* can be transmitted on the loop 34*a*. Pulse 106*b* prevents the devices in the plurality 10-1 from going into alarm notwithstanding the fact that irrespective devices are being energized by the loop 34*a*. Instead, in response to the presence of pulse 106*b*, all previously installed members of the plurality 10-1 remain silent.

Subsequently, the second pulse 106*c* can be transmitted periodically, for example at one second intervals, to cause the previously installed devices on the loop 34*a* to remain silent in a test/install mode. In the event that the control circuitry 32*a* ceases to transmit the control pulses 106*c* periodically the devices in the plurality 10-1 will revert to their alarm state. This represents a fail-safe configuration.

The pulse 106*c* additionally directs the newly installed devices to execute their self tests/install routine one time and emit in response thereto a brief indicia, either visibly or audibly or both which is indicative of expected or normal operation. Subsequently though each of those newly installed devices will remain in a silent state for the duration of the availability of the pulses 106*c*. Once the pulses 106*c* are terminated by the circuitry 32*a*, assuming the driving voltage 106*a* is still present, all of the newly installed devices will enter their alarm state. PARA0Alternately, waveform 104 could be transmitted without the initial pulse 106*b*. In this instance the inhibiting pulse train, pulses 106*c*, would be continuously transmitted on the loop 34*a* until the process of installing the remaining additional devices of the plurality 10-*a* has been completed. In this configuration, previously installed devices would all carry out their respective self test/install function once when power is initially applied to the loop 34*a*. As noted above, if a device, such as device 10*a* is temporarily removed from the loop 34*a*, when reinstalled it will repeat the self test/install sequence one time again confirming proper installation and proper operation. PARA0The above configuration with waveform 104 exhibits the advantage that once the self test/install pulses 106*c* have been terminated, assuming the loop 34*a* is still powered, all of the units on the loop, plurality 10-1, will return to a full alarm state. PARA0An install mode can similarly be provided for units 10'. In normal operation, these units are substantially continuously powered by loop or medium 34. An install mode command can be continuously transmitted on loop 34. In response to this command, a newly installed unit, such as unit 10*n*', can carry out a single self-test, or install function. If operating properly, it could emit a brief audible and/or visual output to the installer who could then move on to the next unit. Once properly installed, the unit(s) could give subsequent install mode commands and enter a normal mode of operation. PARA0In summary, previously installed devices remain silent, but may be active, in the presence of install mode control signals. A newly installed device executes its self-test sequence once and then remains silent in the presence of the install mode control signals (through it may be active and respond to other control signals). If a device is removed temporarily and then re-installed, it will again execute its self-test sequence one time. PARA0From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. An alarm indicating apparatus comprising:

a source of first synchronizing control pulses usable to synchronize alarm indicating output devices in a first, normal, mode of operation;

a communications medium;

at least one output device couplable to the source, via the medium, the device having a normal mode of operation responsive to the first control pulses and a second mode of operation, activated for a limited, predetermined time interval, upon being coupled to the medium, and responsive to different control pulses whereupon the output device emits at least one non-alarm indicium indicative of normal device operation.

2. An apparatus as in claim 1 wherein the device includes circuitry to switch to a normal mode of operation in the absence of the different set of control pulses.

3. An apparatus as in claim 2 where the circuitry includes executable instructions to switch to the normal mode of operation in the absence of the different set of control pulses.

4. An apparatus as in claim 2 wherein the circuitry includes a programmed processor that switches the device to the normal mode of operation in the absence of the different set of control pulses.

5. An apparatus as in claim 1 which includes an additional plurality of output devices coupled to the medium, the plurality of output devices responds to the different set of control pulses and does not enter the normal mode of operation.

6. An apparatus as in claim 5 where the at least one output device becomes a member of the plurality subsequent to a predetermined time interval.

7. An apparatus as in claim 6 where the medium comprises a cable and the source couples electrical energy to the members of the plurality as well as the first control pulses and the different control pulses.

8. An apparatus as in claim 1 where the at least one output device, in a normal mode of operation, emits at least one of an audible alarm or visual alarm in response to applied electrical energy.

9. An apparatus as in claim 8 where the at least one output device, in the second mode, emits at least one of a non-alarm audible output or a non-alarm visual output in response to the different set of control pulses.

10. An alarm indicating output device comprising:

an input port for receipt of at least two different control signals as well as electrical energy;

at least one transducer for emitting human perceptible indicia; and control circuitry coupled to the input port and the at least one transducer, the control circuitry responsive to applied electrical energy to cause the transducer to emit an alarm indicating output, and responsive to a selected control signal to emit a different output indicative of a selected, non-alarm, state for only a predetermined time interval notwithstanding the subsequent presence of the selected control signal.

11. An output device as in claim 10 with the control signal comprising one of different levels or different pulses.

12. An output device as in claim 10 with the control circuitry including a programmed processor with executable instructions for responding to the selected control signals.

13. An output device as in claim 12 where the processor responds to control signals which comprise first and second, different pulse trains which modulate an electrical energy related signal.

14. An output device as in claim 10 where the at least one transducer comprises at least one of a visual output device or an audible output device, the device is operable to provide both an alarm indicating output and a non-alarm indicating output energized by the electrical energy from the input port.

15. An output device as in claim 14 with the control circuitry including a programmed processor for responding to at least the first and second different control signals.

16. An output device as in claim 15 with the processor including executable instructions that respond to the second control signal to emit output indicia for only the predetermined time interval measured relative to the initial receipt of electrical energy.

17. An indicating unit comprising:

a port for receipt of electrical energy and control signals;

control circuitry, coupled to the port, for receipt of the control signals, including circuitry for responding to the control signals to enter at least an install output mode, the install output mode being entered into in the on-going presence of the install mode control signals.

18. A unit as in claim 17 where the control circuitry includes a processor and instructions executable thereby to determine how to respond to the install mode control signals.

19. A unit as in claim 17 which includes instructions for establishing an install time interval.

20. A unit as in claim 17 which includes instructions for emitting an alarm output in the first output mode, or emitting an install output, in response to entering the install output mode but only in the presence of the install mode control signals.

21. A method of installing an electrical unit in a system comprising:

providing a first, non-alarm indicating signal sequence;

energizing a unit being installed in the system and coupling the first sequence thereto;

providing at least one of an audible or a visual indicator indicative of normal operation of the unit for a predetermined period of time during which the first sequence is coupled to the unit.

22. A method as in claim 21 where the unit reverts to a different mode of operation after the predetermined period of time.

23. A method as in claim 21 which includes modulating delivery of electrical energy with at least the first sequence.

24. A method as in claim 21 which includes coupling the first sequence to another unit being installed; and providing at least one of an audible or a visual indicator indicative of normal operation of the another unit for the predetermined period of time.

25. A method of installing an electrical unit in a system comprising:

providing a first, non-alarm indicating signal sequence;

energizing a unit being installed in the system and coupling the first sequence thereto;

providing at least one of an audible or a visual indicator indicative of normal operation of the unit for a predetermined period of time during which the first sequence is coupled to the unit; which includes modulating delivery of electrical energy with at least the first sequence; and coupling the first sequence to a second previously installed unit at a selected time, determining that the second unit was previously installed at an earlier time with the interval between the selected time and the earlier time exceeding the predetermined period of time and, responsive thereto, not providing the indicator of normal operation in response to the first sequence.

* * * * *